United States Patent [19]

Shooltz

[11] 4,371,160

[45] Feb. 1, 1983

[54] EXERCISE DEVICE FOR RUNNERS

[76] Inventor: Michael L. Shooltz, 191 Hamilton St., Cambridge, Mass. 02139

[21] Appl. No.: 240,478

[22] Filed: Mar. 4, 1981

[51] Int. Cl.[3] ..... A63B 23/04; A63B 21/04

[52] U.S. Cl. ..... 272/96; 272/142

[58] Field of Search ..... 272/96, 142, 146, 134, 272/136, 138

[56] References Cited

U.S. PATENT DOCUMENTS

| | | | |
|---|---|---|---|
| 735,319 | 8/1903 | Urwick | 272/96 |
| 1,671,096 | 5/1928 | Anderson | 272/96 |
| 3,421,760 | 1/1969 | Freeman | 272/96 |
| 3,672,670 | 6/1972 | Burzenski | 272/96 |
| 4,310,155 | 1/1982 | White | 272/96 |

FOREIGN PATENT DOCUMENTS

| | | | |
|---|---|---|---|
| 227 | of 1902 | United Kingdom | 272/96 |
| 3584 | of 1906 | United Kingdom | 272/136 |

*Primary Examiner*—Richard J. Johnson

[57] ABSTRACT

A foot, ankle, and leg exercise device is designed to develop and/or rehabilitate those specific muscles of the foot, ankle and leg which are not properly developed during the act of running or jogging. The user attaches his/her feet to foot pads on the device. When the pads are lifted by the feet against an adjustable resistance from a combination spring and shock cord mechanism, the anterior muscles of the leg are exercised while the posterior, or prime mover muscles, remain inactive.

5 Claims, 3 Drawing Figures

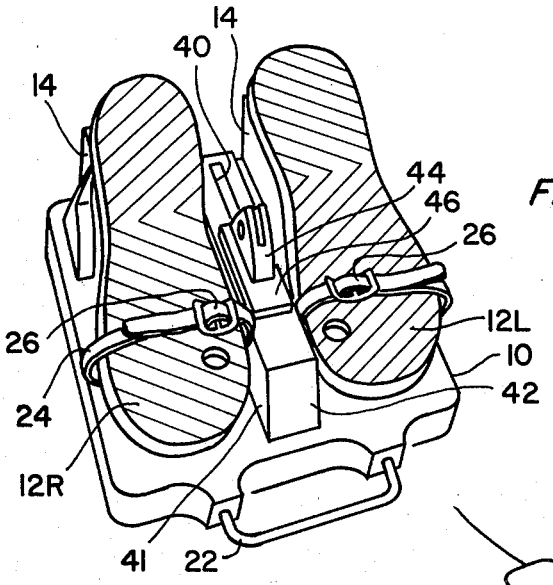
Fig. 1
Fig. 2
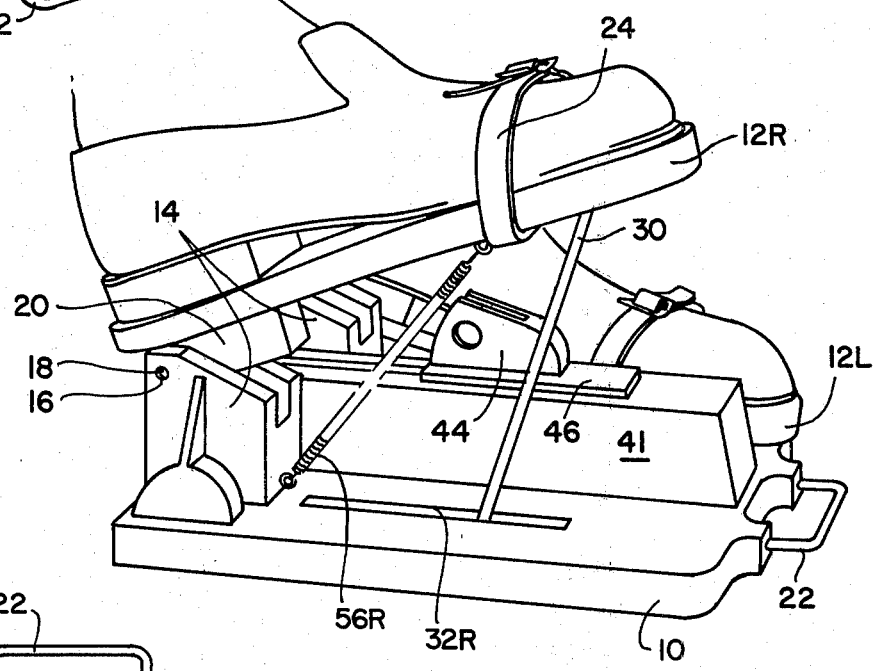
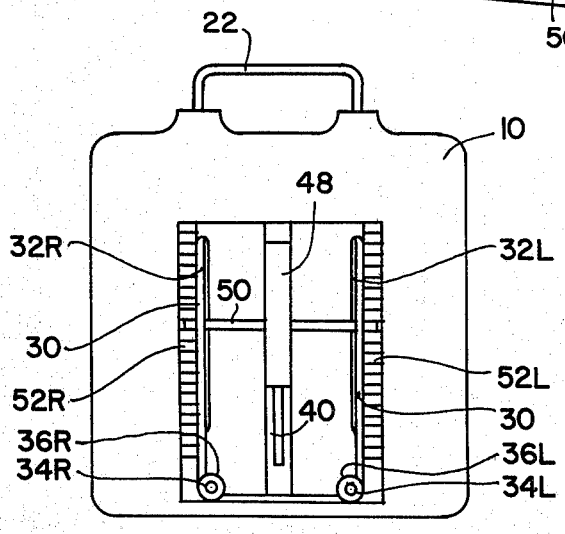
Fig. 3

EXERCISE DEVICE FOR RUNNERS

BACKGROUND OF THE INVENTION

This invention pertains to exercise equipment, and particularly to equipment for developing specific foot, ankle and leg muscles for runners and joggers.

The act of running or jogging consists of a very specific motion repeated thousands of times per hour. This motion employs a particular group of muscles referred to as "prime movers," the muscles along the back of the leg and the thigh. Running regularly over a period of time causes overdevelopment of these prime movers. They become short, tight and inflexible. The antagonist muscles, those on the front of the leg, become relatively weak.

The simple cause of the problem is that the posterior muscles, or prime movers, are doing the work during running while the anterior, or antagonist muscles, are relative inactive. An imbalance of strength and flexibility is created between these two muscle groups. As the tendons, ligaments, and muscles of the foot and legs try to compensate for this imbalance, they are forced to work harder and in ways in which they were not intended. These factors are a primary cause of many common running injuries such as tendonitis, shin splints, and stress fractures.

The current state of the art in foot exercise equipment consists of machines or devices designed to provide resistance to a pushing or downward motion of the foot. This pushing or downward motion of the foot is accomplished through the efforts of the prime mover muscle group. This is the same muscle group utilized in the act of running. Use of these devices by a regular runner will further develop the prime mover muscle group, thus increasing both muscle imbalance and the risk of injury.

SUMMARY OF THE INVENTION

Accordingly, my objective is to prevent or rehabilitate this type of muscle imbalance by means of a device that exercises the anterior muscles of the leg, but not the posterior, or prime mover, muscles. My invention accomplishes this objective by providing an exercise in which the user's foot is lifted and pivoted upwardly against a resistance. A foot pad pivotally connects at its heel to an elevating block. The block is mounted on a base; a restraining element connects to the foot pad to hold the user's foot in place. A biasing assembly attaches to the base and to the foot pad for exerting downward pressure on the foot pad. This pressure resists upward foot movement and thereby exercises the anterior leg muscles.

The following drawings and description of the invention set forth the invention so a person skilled in the field of exercise equipment can make and use it. They also describe the preferred embodiment and set forth the best mode of carrying out the invention.

DESCRIPTION OF THE DRAWINGS

FIG. 1 is a top perspective view of an illustrative embodiment of the invention.

FIG. 2 is a side perspective view of the embodiment in FIG. 1.

FIG. 3 is a bottom perspective view of the embodiment in FIG. 1.

DESCRIPTION OF THE INVENTION

With an exerciser according to this invention, an individual's feet are attached by straps to foot pads that are elevated at the heel. To exercise the anterior muscles, the user pivots his feet at the heels to lift the toes of the foot pads against downward pressure that a biasing assembly exerts on the pads. This action flexes the anterior muscles of the leg while the posterior muscles extend and relax.

Although the embodiment in the following description illustrates a device with two foots pads, modified embodiments could use only one foot pad. Such embodiments could be used for physical therapy, for example, where only one leg requires rehabilitation or development. The following description shows a preferred embodiment for runners who want to correct muscles in both legs equally.

The invention includes a generally rectangular base 10 and two foot-shaped pads 12R and 12L upon which a user places his feet. The top surface of the foot pads can be grooved to prevent slipping. Use of two foot pads allows the exercise device to be held securely in place with one foot while exercising the opposite foot. This eliminates the need to otherwise secure the device. If the device were to be modified to include only one pad, immobile pads could be placed on each side of the foot pad so the resting foot could stabilize the device.

At the back end of the device, the heel of each foot pad is elevated by a supporting block 14 that is bolted to be integral with the top surface of the base 10. Each block has a transverse aperture 16 for a pivot pin 18 about which the foot pad 12 pivots. In FIG. 2, the pivot pin extends through a heel 20 that connects to the foot pad 12. A restraining means attaches to each foot pad for holding the user's foot on the respective pads 12R and 12L. For example, each pad includes an adjustable strap 24. The strap 24 connects to the bottom, sole portion of the foot pad and extends over the top of the runner's foot. A buckle 26 fastens the strap in place over the foot. Thus, the restraining means holds each foot to its pad so that when the foot is lifted, it pivots on the heel and raises the toe. For carrying the device, a handle 22 extends from the front end of the base 10.

To resist upward movement of the toe of the runner's foot, a biasing means exerts downward pressure on the foot pads 12. This assembly includes a sliding shock cord mechanism with a shock cord 30 that attaches to the bottom surfaces of the foot pads 12R and 12L (FIG. 2) and extends through and along the bottom of the base 10. In FIG. 2, the shock cord 30 extends through a longitudinal slot 32R in the base, directly under foot pad 12R. This slot 32R is parallel to slot 32L that runs longitudinally under the left foot pad 12L. From the slot 32R, the shock cord extends rearward along the bottom surface of base 10 to guide posts 34R and 34L. These guide posts sit at the rearward end of the longitudinal slots 32R and 32L, respectively. The shock cord extends under a washer 36R on the guide post 14R and bends 90° around guide post 34R. Then the cord extends transversely to guide post 34L and under washer 36L, bends 90° around guide post 34, and extends forward. Finally, the cord extends upward through the longitudinal slot 32L and attaches to foot pad 12L.

In operation, the feet are lifted one at a time. As each foot is lifted, the shock cord 30 slides around the shock cord guide posts 34 and washers 36 in the direction in which it is pulled. To assure that equal tension is exerted on each foot pad, the cord slides freely in either direction. The cord must be long enough so the foot pads can move upward through the full range of the foot's normal flexion before the cord stretches to its limit.

To adjust the resistance that the shock cord 30 exerts on the foot pads, a shock cord tension adjuster varies the distance over which the cord stretches. On the center of base 10 is a longitudinal slot 40. Longitudinal side walls 41 and 42 and the slot 40 form a guide well. This guide well houses a centerpiece 44 that slides forward and backward in the well.

The centerpiece includes a plate 46 that slides along the top surface of the sidewalls 41 and 42. A mid-portion, or body (not visible in FIG. 2) of the centerpiece 44 extends downward through the guide well. Attached to the body is an arm 48 that extends longitudinally along slot 40 in the bottom of the base 10. The arm 48 connects to a transverse arm 50, which the shock cord 30 passes over as seen in FIG. 3. The shock cord 30 extends downward from footpad 12R, as FIG. 2 shows, to the transverse arm 50 of FIG. 3, around which shock cord 30 bends to extend horizontally rearward toward guidepost 34. The part of the shock cord 30 that extends downward is best seen in FIG. 2 and can also be seen in FIG. 3 as the part of the shock cord 30 that appears forward (up in FIG. 3) from transverse rod 50. From transverse rod 50, it extends around guidepost 34L, as was described above, and it proceeds horizontally forward from there to the transverse arm 50, from which it extends slightly upward to the (resting as seen in the drawings) left foot pad 12L.

As the centerpiece 44 slides in the guide well, this transverse arm 50 slides along the bottom of base 10. Forward movement of the centerpiece 44 moves the arm 50 forward and increases the distance over which the shock cord 30 must stretch. This increases the downward pressure exerted on the foot pads 12R and 12L. Rearward movement of the centerpiece 44 and arm 50 reduces the distance over which the shock cord 30 must stretch, and reduces the downward pressure exerted on the foot pads.

To retain the transverse arm 50 in a desired postion, longitudinal rows 52R and 52L of transverse grooves run along the bottom of the base 10. The pressure exerted by the shock cord 30 forces the transverse arm 50 into corresponding groove to hold it.

To change the position of the transverse arm 50, the centerpiece 44 is depressed to move the arm 50 out of the grooves holding it. While depressed, the centerpiece 44 is moved forward or backward within the guide well. When the tension of the cord 30 has been varied as desired, the centerpiece is released, and the arm 50 is held in a new set of grooves.

To maintain a base level of resistance against upward movement of the foot pads, the biasing means includes springs that supplement the sliding shock cord mechanism. Cylindrical springs 56R and 58R are attached between the bottoms of the foot pads 12R and 12L and the top surface of the base 10. In FIG. 2, spring 56R is shown attached to the base near block 14 and to the bottom, sole portion of foot pad 12R. The springs can be easily removed to replace them with springs that provide more or less tension.

In operation, the preferred embodiment of the invention is used while the operator is sitting. Because it is relatively small, it can be conveniently used even at an office desk or table during working hours. The user first straps his or her feet to the respective foot pads 12R and 12L so that upward motion of the feet lift the foot pads. With both feet strapped to the foot pads, each is alternatingly lifted against the downward pressure exerted by the biasing means. As each foot is lifted, the heel 20 of the foot pad pivots on the pivot pin 18 while the toe of the foot pad raises. Because the biasing means resists the upward movement of the feet by exerting downward pressure on the foot pads, the muscles responsible for pivotally lifting the foot pads are exercised. These are the anterior muscles of the feet, ankles, and legs, which flex to lift the foot pads while the posterior, or prime mover, muscles extend and relax. By alternatively lifting the feet, the user exercises each one equally. Thereby, the device develops the antagonist muscles in the legs, thus eliminating imbalances which are a primary cause of many of the leg disorders that plague runners. For therapeutic use, the device can be used to selectively exercise the anterior leg muscles that might have atrophied or been injured.

This description discloses the preferred embodiment of the invention. To accomplish substantially the same result, equivalent elements could be used consistent with the basic principles of the invention. For example, the blocks 14 can be any supporting structure(s) that elevate the heels of the foot pads 12R and 12L and allows them to pivot. Similarly, the biasing assembly and shock cord tension adjuster could be modified to form equivalent structures that operate on the top surface of the base 10 rather than the bottom surface as in the preferred embodiment. Or, as previously mentioned, an alternative embodiment could include only one foot pad. Therefore, I intend the following claims to cover all equivalents and variations that come within the spirit of the invention.

I claim:

1. A foot and leg exercise device including:

A. a supporting base;

B. a supporting block attached to the base at one end;

C. a foot pad having a heel pivotally connected to and elevated by the block;

D. a restraining means attached to the foot pad for holding the user's foot on the pad; and E. a biasing means attached to the base and to the foot pad for exerting downward pressure on the foot pad to resist upward pivotal movement of the user's foot, the biasing means including a path-defining member on the base and a sliding shock cord that is attached to the foot pad at one end, is trained around the path-defining member for sliding with respect to it, and is secured at the other end to require stretching of the shock cord when the foot pad is pivoted away from the base.

2. The exercise device of claim 1, further including a shock cord tension adjuster attached to the base to vary the downward pressure applied to the foot pad.

3. The exercise device of claim 2, in which the tension adjuster includes a sliding arm that varies the distance over which the shock cord extends by contacting the cord at one or more points.

4. The exercise devices of claims 1 or 3, in which, the biasing means further includes a spring attached to the base and to the foot pad for maintaining a base level of downward pressure against upward movement of the foot pad.

5. A foot and leg exercise device including:

A. a supporting base;

B. a supporting block attached to the base at one end;

C. two foot pads, each with its heel pivotally connected to and elevated by the block:

D. a restraining means attached to the foot pads for holding the user's feet on the pads; and E. biasing means attached to the base and to the foot pads for exerting downward pressure on the foot pads to resist upward pivotal movement of the user's feet, the biasing means including a path-defining member on the base and a shock cord that attaches to one of the foot pads by one end, extends downward to the base, is trained around the path-defining member to slide with respect to it, extends upward to the other foot pad, and attaches to the other foot pad by the other end.

* * * * *